US009893414B2

(12) United States Patent
Pascual Gil et al.

(10) Patent No.: US 9,893,414 B2
(45) Date of Patent: Feb. 13, 2018

(54) ANTENNA ASSEMBLY FOR AIRCRAFT

(71) Applicant: Airbus Defence and Space S.A., Madrid (ES)

(72) Inventors: Enrique Pascual Gil, Madrid (ES); Fracisco Javier Jimenez Gonzalez, Madrid (ES)

(73) Assignee: Airbus Defence and Space S.A., Madrid (ES)

( * ) Notice: Subject to any disclaimer, the term of this patent is extended or adjusted under 35 U.S.C. 154(b) by 323 days.

(21) Appl. No.: 14/778,500

(22) PCT Filed: Mar. 20, 2014

(86) PCT No.: PCT/ES2014/070206
§ 371 (c)(1),
(2) Date: Sep. 18, 2015

(87) PCT Pub. No.: WO2014/147279
PCT Pub. Date: Sep. 25, 2014

(65) Prior Publication Data

US 2016/0294043 A1 Oct. 6, 2016

(30) Foreign Application Priority Data

Mar. 20, 2013 (EP) ..... 13382100

(51) Int. Cl.
*H01Q 1/28* (2006.01)
*H01Q 7/00* (2006.01)
(Continued)

(52) U.S. Cl.
CPC ..... *H01Q 1/287* (2013.01); *H01Q 1/42* (2013.01); *H01Q 1/48* (2013.01); *H01Q 7/00* (2013.01); *H01Q 9/42* (2013.01)

(58) Field of Classification Search
CPC ..... H01Q 1/287
See application file for complete search history.

(56) References Cited

U.S. PATENT DOCUMENTS 6,982,677 B2 1/2006 Kennedy et al.
7,511,672 B2 3/2009 Su et al.
(Continued)

FOREIGN PATENT DOCUMENTS

CN 102 263 317 11/2011
GB 655436 7/1951

OTHER PUBLICATIONS

European Search Report cited in PCT/ES2014/070206 dated Jun. 2, 2014, two pages.

*Primary Examiner* — Jessica Han
*Assistant Examiner* — Amal Patel
(74) *Attorney, Agent, or Firm* — Nixon & Vanderhye P.C.

(57) ABSTRACT

An antenna assembly for aircraft including: a vertical tail of the aircraft including a front spar, a leading edge skin covering a leading portion of the front spar and a rib extended between the front spar and the leading edge skin; an antenna radiating element extending a length of the vertical tail and positioned between the leading edge skin and the front spar; a first metallic element included with or attached to the front spar; a second metallic element, wherein the second metallical element is electrically coupled to the antenna radiating element and to the first metallic element; an antenna coupler in electrical electrically connected to the antenna radiating element and the first metallic element, and wherein a closed looped electrical circuit is formed by the antenna radiating element, the first metallic element, the second metallic element and the antenna coupler.

18 Claims, 5 Drawing Sheets

(51) Int. Cl.

| | |
|---|---|
| ***H01Q 9/42*** | (2006.01) |
| ***H01Q 1/48*** | (2006.01) |
| ***H01Q 1/42*** | (2006.01) |

(56) References Cited

U.S. PATENT DOCUMENTS

| | | | | |
|---|---|---|---|---|
| 7,511,674 | B2 * | 3/2009 | McNutt | H01Q 1/28 343/705 |
| 7,737,898 | B2 | 6/2010 | Hanusa et al. | |
| 8,228,248 | B1 | 7/2012 | Kahle et al. | |
| 8,354,968 | B1 | 1/2013 | Paulsen et al. | |
| 2014/0159965 | A1 * | 6/2014 | Le | H01Q 1/28 343/705 |

* cited by examiner

ANTENNA ASSEMBLY FOR AIRCRAFT

RELATED APPLICATIONS

This application is the U.S. national phase of International Application No. PCT/ES2014/070206 filed 20 Mar. 2014 which designated the U.S. and claims priority to EP 13382100.9 filed 20 Mar. 2013, the entire contents of each of which applications are hereby incorporated by reference.

FIELD OF THE INVENTION

The present invention refers to an antenna assembly. More specifically it refers to a shunt antenna for high frequency (HF) communications integrated in a vertical tail plane (VTP) of an aircraft.

BACKGROUND OF THE INVENTION

Currently high frequency linear wire antennas are commonly used in military transport in-service aircraft. Linear wire antennas have aerodynamic disadvantages and they also need extra auxilliary attachments to avoid possible safety risks caused by broken wires. Another drawback of wire antennas is that their mechanical and radio electrical characteristics are degraded during the aircraft service life due to vibrations caused by aerodynamic drag.

High frequency shunt antennas located in the vertical stabilizer of an aircraft are also known. Said antennas fail to efficiently cover lower frequencies due to their shorter length compared to wire antennas, as their length is limited by the available space inside the vertical stabilizer.

Shunt antennas have been used in aircraft vertical tail surfaces for many years. Their use in aircraft tail surfaces causes the whole tail surface to radiate/receive a high frequency radio signal and results in an almost equal 360-degrees propagation or ability to receive a radio frequency (RF) signal. The entire tail surface becomes a radiator/receiver of the RF signals from/to the antenna. The tail surfaces of the aircraft increase the surface area of the antenna and increase the propagation or ability to receive the RF signal to/from all directions.

An aircraft vertical tail comprises a leading edge, a torsion box, as its main supporting structure, and a trailing edge with control surfaces (rudders). The torsion box comprises a front spar, a rear spar and ribs extending from the front spar to the rear spar. Also, a known leading edge comprises several ribs, called leading edge ribs, attached to the front spar.

A shunt antenna for aircraft mountable in a dorsal fin of a vertical tail plane is disclosed in U.S. Pat. No. 7,511,624. An antenna radiating element is integrated into the dorsal fin structure being attached to the top inside composite skin of a new dorsal fin structure that replaces the original dorsal fin. The rear end of the antenna radiating element is connected to the fuselage such that a current loop is formed between the dorsal fin and the fuselage. A drawback of the disclosed invention is that a portion of the dorsal fin has to be replaced by a metallic part.

A dorsal high frequency antenna as that disclosed in U.S. Pat. No. 8,228,248 is also known. The antenna system is joined to the fuselage of the aircraft, so it is also mounted on the fuselage and it is electrically coupled to the surface of the vertical tail plane.

The above disclosed shunt antennas are mounted on the dorsal fin of the vertical tail plane and connected to the fuselage and tail surfaces which causes the external surface of the tail plane to radiate/receive.

Said shunt antennas have several drawbacks. They mainly interact with the surfaces covered by the dorsal fin, which limits the space available for them. For many aircraft, said limitation in size does not allow a correct operation at lower frequencies.

As they are not attached to the structure of the VTP, vibrations and deflections of the fuselage surfaces can degrade their electrical connections and therefore its radio electrical performances.

Additionally, some extra conducting elements are necessary to ensure grounding of the antenna to the primary structure of the VTP to drain high currents coming from a lightning strike.

Moreover, the situation of the antenna element near the surface of the dorsal fin makes it more exposed to be affected in case of a bird impact, the complete loss of the antenna being even possible.

Another known shunt antenna for an aircraft is disclosed in U.S. Pat. No. 8,354,968B1. The antenna is composed of a radiating element, that may be mounted on several placements on aircraft, such as inside fuselage, horizontal stabilizers or leading edge of vertical stabilizers. Furthermore its radiating element is composed of several shunt metallic plates put in parallel each other in order to decrease its reactance and so its parallel resistance. This configuration increase the total weight of the antenna assembly and in some aircraft locations its installation or integration may be very difficult since more space is required.

SUMMARY OF THE INVENTION

The above mentioned drawbacks are solved by the claimed shunt antenna which is mountable on an aircraft.

The claimed antenna assembly comprises an antenna radiating element and at least an antenna coupler operatively connected to the antenna radiating element. It also comprises a vertical tail plane structure having a front spar, a first metallic element which comprises a portion of the front spar, a second metallic element located in electrical contact with the antenna radiating element and with the first metallic element. Moreover the antenna radiating element, the first and the second metallic elements and the antenna coupler are configured as an electrical circuit such that in use the current flowing through the circuit describes a closed loop.

An electrical circuit is a path in which electrons from a voltage or current source flow, therefore electric current flows in a closed path called an electric circuit.

For the current being transmitted from the first metallic element to the coupler such that the antenna assembly elements are configured as an electrical circuit, both the antenna coupler and the vertical tail structure has to be electrically connected.

The antenna coupler and antenna radiating element are operatively connected such that they are configured as an electrical circuit which also means that both elements are in electrical contact.

As the claimed invention comprises a portion of the front spar of the vertical tail plane, the antenna is directly attached to the structural members of the VTP. It allows a structurally integrated design which avoids the aforementioned disadvantages and which also fulfils the electromagnetic performance requirements and eases the mechanical integration of the antenna within the structure under the leading edge to better withstand the loads, also producing a reduction in aerodynamic drag and its associated savings in fuel costs.

As the antenna is an integral part of the VTP structure there are no space limitations, obtaining thus a good operation at lower frequencies. Degradation of radio electrical characteristics due to vibration and deflections are also minimized and the possible damage due to bird impact is considerably reduced. No auxilliary attachments are necessary to ensure safety because the possibility of a broken HF wire disappears.

Another advantage of the claimed invention is the simplicity of its design, which makes the antenna an economically viable alternative to the traditional wire antenna with no need of extra elements to ensure the protection against lightning strikes. Furthermore, this solution presents a very low weight since only one shunt metallic plate with an adequate shaping is required to decrease antenna reactance and so its parallel resistance.

Another advantage of the antenna is that it can be installed without additional down time during a routine aircraft maintenance check.

The claimed antenna makes use of part of the aircraft structure, more specifically of the vertical tail plane as a radiating element, turning it into a structural antenna for the high frequency band. It means that the current directly flows through the VTP's internal structure, thus making it able to radiate/receive. As the internal structure is joined to the external surface, both elements radiate/receive not only the external surface as disclosed in the background of the invention. This increases the total radiating/receiving area of the shunt antenna which leads to an improvement in quality of the communication.

Moreover, the orientation of the radiating element in the VTP which is located along its front spar and therefore inclined with respect to a vertical plane, provides suitable directivity in all directions, in both vertical and horizontal polarizations, and at low and high elevation angles, making it compatible for ground-wave and sky-wave propagation modes, this last, including also NVIS (Near Vertical Incident Skywave) radiation which needs a high level of vertical radiation not offered by the shunt antennas disclosed in the background of the invention.

The claimed invention overcomes the limitations of the current airborne systems, providing suitable performances with low weight and minimum impact for its integration on aircraft structure, reduced maintainability (mechanical issues significantly reduced) and a solution respecting the environment as it reduces fuel consumption.

DETAILED DESCRIPTION OF THE INVENTION

Figure 1A:
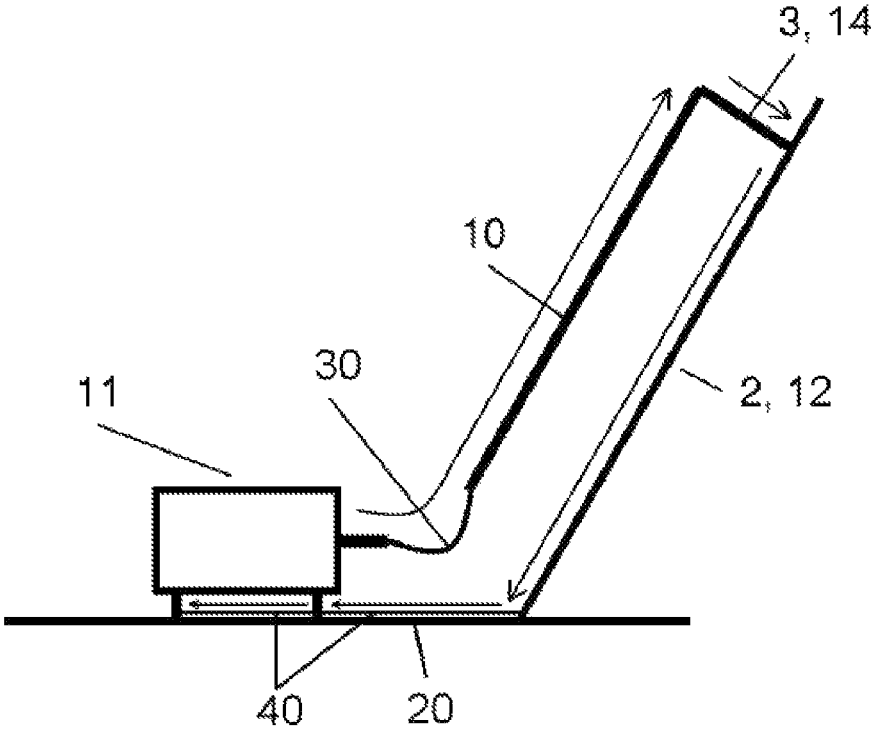
FIG. 1*a* is a schematic view of an embodiment having a non-metallic fuselage wherein the closed loop is created by the connection of the antenna coupler, the antenna radiating element, the first and the second metallic elements and an electrical connection between the first metallic element and the coupler.

As described in the figures the antenna assembly comprises the antenna radiating element (10) and a portion of the front spar (2) of the vertical tail plane (1), which is the first metallic element (2, 12) of the antenna assembly. It also comprises a second metallic element (3, 14) located in electrical contact with the antenna radiating element (10) and with the first metallic element. FIGS. 1, 2, 3 and 4 show the antenna radiating element (10) parallel to the portion of the front spar (2).

Figure 1B:
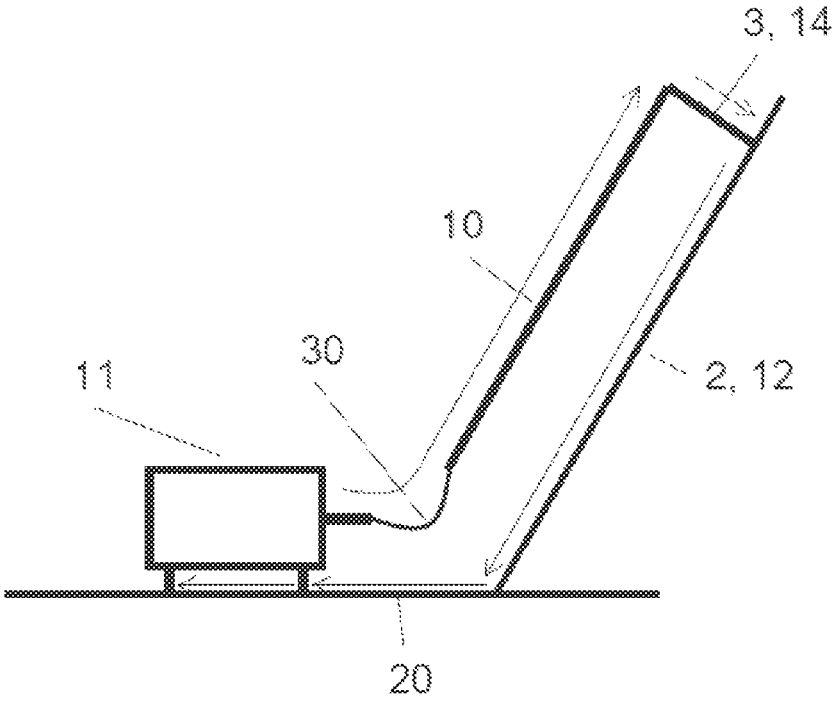
FIG. 1*b* is a schematic view of an embodiment having a metallic fuselage wherein the closed loop is created by the connection of the antenna coupler, the antenna radiating element, the first and second metallic elements and the fuselage.

FIGS. 1*a* and 1*b* show a schematic view of the closed loop created by the connection of the elements of the antenna assembly. The antenna coupler (11) is electrically connected to the antenna radiating element (10) which is in electrical contact with the second metallic element which is also in electrical contact with the first metallic element which is also in electrical contact with the antenna coupler (11) by means of the fuselage (20) or by means of an element (40) able to transmit the electric current both extending between the first metallic element and the coupler (11). The current path is shown in the figures by the arrows.

FIG. 1*a* shows an embodiment in which the fuselage (20) is non-metallic, therefore unable to transmit an electrical current. In this embodiment for performing an electrical circuit in which a closed loop is described, the first metallic element and the coupler (11) are to be connected by an element (40) able to transmit the electric current, for instance, a cable, a metallic element, etc, Therefore, the antenna assembly further comprises said element (40) able to transmit the electric current that extends between the first metallic element and the antenna coupler (11).

FIG. 1*b* shows an embodiment in which the fuselage (20) is metallic. As shown in FIGS. 1*a*, 1*b*, 2, 3 and 4 the first metallic element is connected to the fuselage (20) of the aircraft and FIGS. 1*a*, 1*b*, 3 and 4 show the antenna coupler (11) also connected to the fuselage (20), therefore as the antenna assembly is configured as an electrical circuit, the current flows through the portion of the metallic fuselage (20) extending between the joint with the first metallic element and with the antenna coupler (11). Therefore the antenna assembly further comprises said portion of the fuselage (20) extending between the joint with the first metallic element and with the antenna coupler (11).

Figure 2:
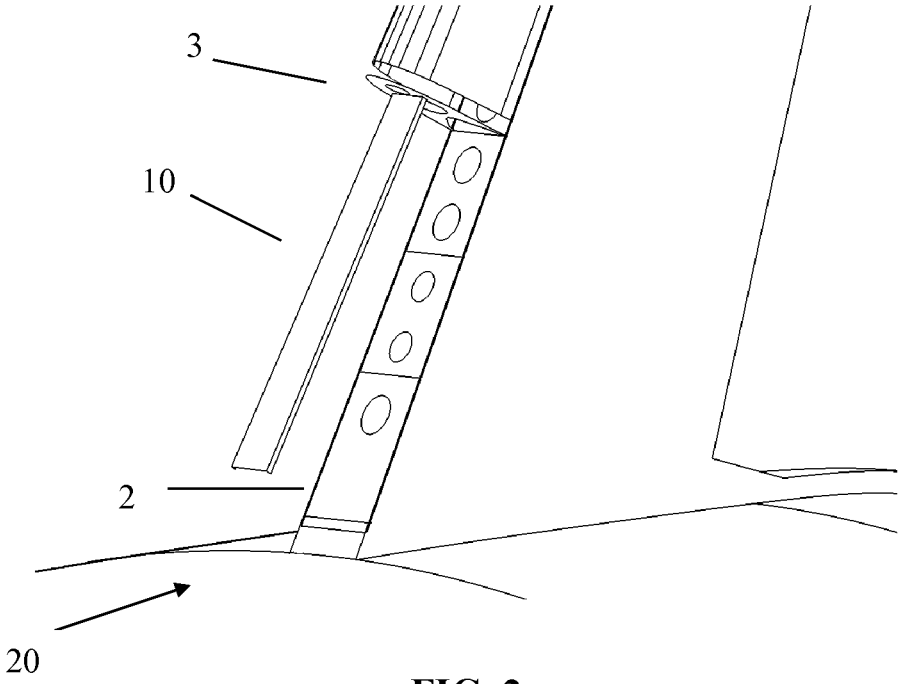
FIG. 2 is a schematic perspective view of a first embodiment of the invention showing for the sake of clarity only the front spar and a leading edge rib of a vertical tail plane and an antenna radiating element.

FIG. 2 shows a first embodiment of the invention. This first embodiment may be used in aircrafts which have an internal metallic structure so that the front spar (2) and the leading edge ribs (3) are metallic. In this first embodiment the second metallic element comprises said leading edge rib (3). In addition the antenna radiating element (10) and the leading edge rib (3) are in direct contact. The fuselage (20) is also metallic.

The antenna coupler (11) is electrically connected to the antenna radiating element (10) and also attached to the fuselage (20) so that the antenna radiating element (10), the leading edge rib (3), the front spar (2), the antenna coupler (11) and the portion of the fuselage (20) extending between the connection with the front spar (2) and the antenna coupler (11) are configured as an electrical circuit in which a closed loop is described by the current path.

Figure 3:
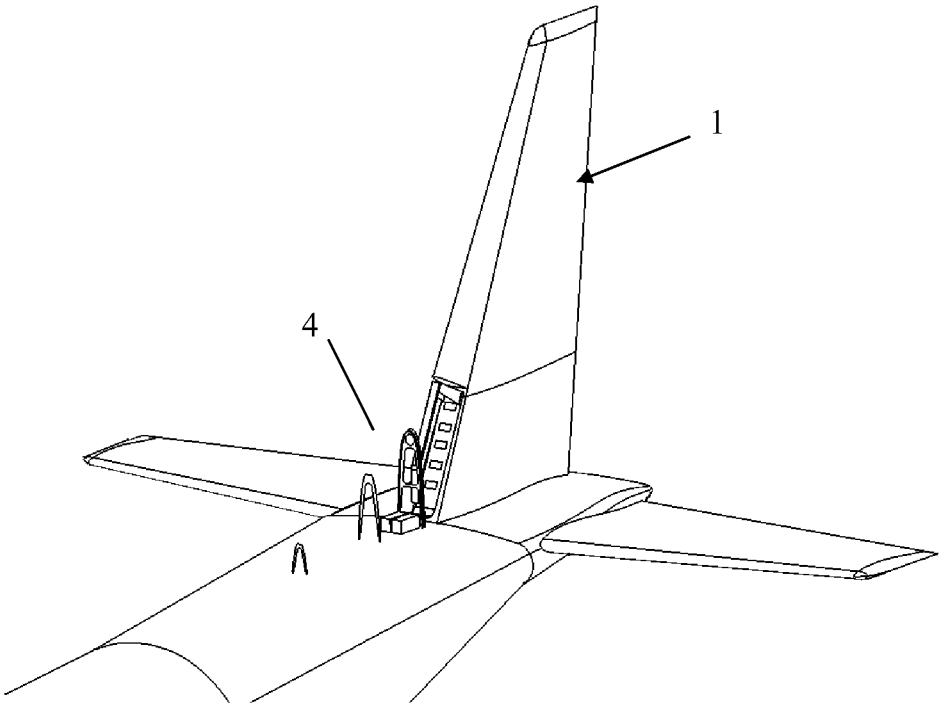
FIG. 3 is a schematic perspective view of a second embodiment of the invention showing a rear part of an aircraft and the antenna assembly.

FIG. 3 shows a perspective view of a second embodiment of the invention, clearly showing that the antenna assembly is integrated into the internal supporting structure, more specifically being arranged as a part of or attached to the front spar (2).

Figure 4:
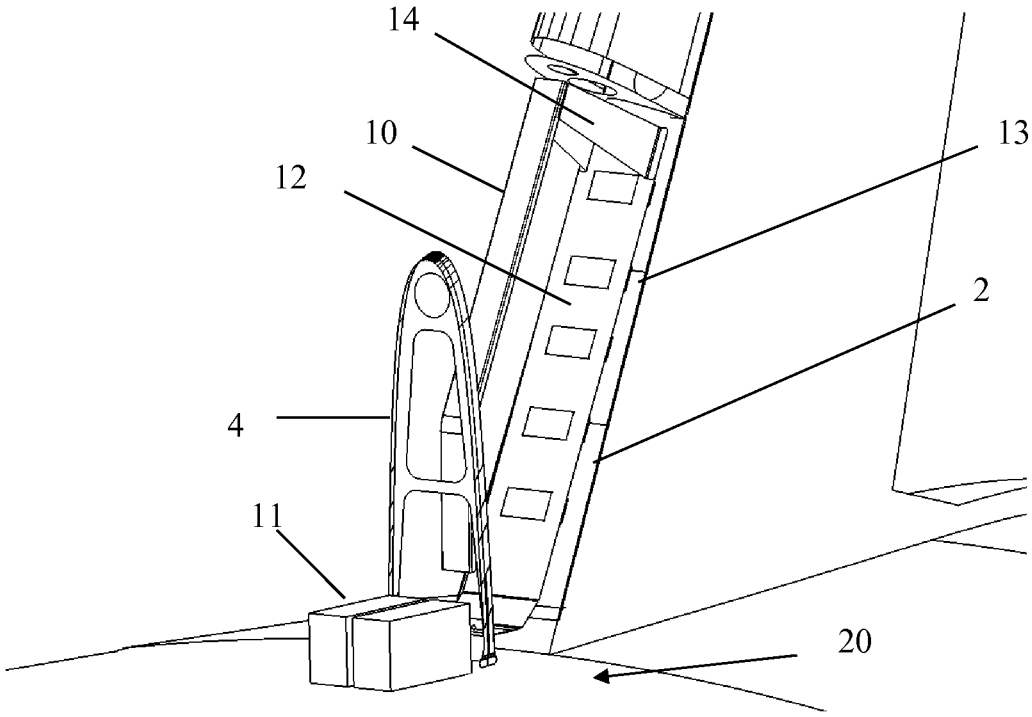
FIG. 4 is a schematic perspective view of the second embodiment of the invention showing the front spar and the antenna assembly.
Figure 5:
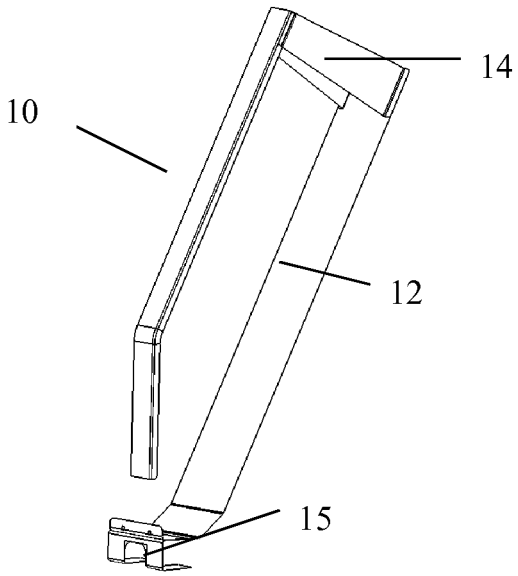
FIG. 5 is a schematic perspective view of the second embodiment of the invention.
Figure 6:
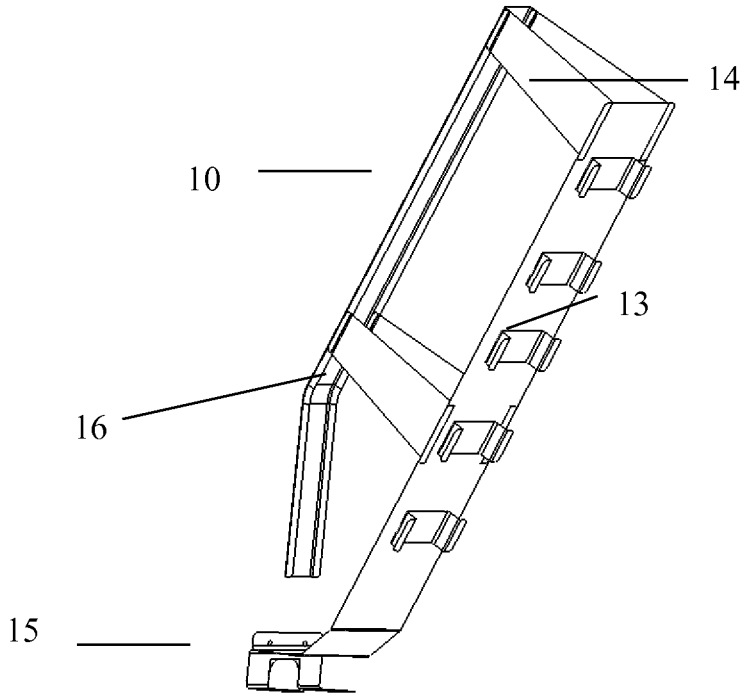
FIG. 6 is a schematic perspective view of the rear part of the embodiment shown in FIG. 5.

FIG. 4 is an expanded view of FIG. 3, showing the antenna radiating element (10) and the front spar (2). In this embodiment the first metallic element also comprises a metallic plate (12), which comprises metallic attaching means (13) to the front spar (2), as shown in FIG. 6. A metallic plate with U shape or grounded metallic plate (15) allows the mechanical and electrical connection of the metallic plate (12) to fuselage (20) which is also metallic and so reproducing the aforementioned closed loop also in this embodiment.

For a non-metallic fuselage (20), ie, for a fuselage (20) made of composite, the grounded metallic plate (15) can be extended until it contacts the antenna coupler (11) such that the electrical connection between the metallic plate (12) and the coupler (11) is made.

It further comprises at least a metallic support mast (14) extending between the antenna radiating element (10) and the metallic plate (12) as a second metallic element. This second embodiment may be used in aircrafts, which have an internal structure made of composite materials, where the front spar (2) and the leading edge ribs (3) are made of composite material. In this second embodiment the first metallic element comprises the front spar (2), which is made of composite and the metallic plate (12), which are directly attached together.

The antenna coupler (11) is operatively connected to the antenna radiating element (10) so that the antenna radiating element (10), the support mast (14) and the metallic plate (12) attached to the front spar (2) are configured as a circuit in which a closed loop is described by the current path. As previously explained, if the fuselage (20) is metallic the current flows through it (20) as the metallic plate (12) is electrically connected with the fuselage (20) by means of the grounded metallic plate (15) and the antenna coupler (11) is also electrically connected to the fuselage (20). If the fuselage (20) is non-metallic an electrical connection between the metallic plate (20) and the antenna coupler (11) has to be provided.

It may further comprises at least a dielectric support mast (16) extending between the antenna radiating element (10) and the metallic plate (12).

The antenna metallic plate (12) is electrically connected to the aircraft structure through the metallic attachments means (13) in contact with the front spar (2) of the VTP (1) and to the fuselage (20) through a specific grounded metallic attachment (15) designed to interconnect this element with the fuselage (20). This design provides good electrical continuity between the metallic plate (12) and fuselage (20), ensuring a low DC impedance path for the radio frequency return current towards the antenna coupler (11) which is also grounded to the fuselage (20), this being a critical feature for proper HF system efficiency.

FIG. 4 also shows a dielectric rib (4), which is used to support a dorsal fin in order not to disturb the antenna radiation pattern.

The antenna radiating element (10) is coupled by one or more feed lines (30) to the HF radio coupler or couplers (11). To increase system efficiency, it is necessary to locate the antenna couplers (11) adjacent to the antenna radiating element (10) to reduce losses and ensure proper antenna coupling. Two feed line attachments could be used, one for couplers (11) with coaxial output using a metallic plate and other for couplers (11) with screwed output using straps.

FIGS. 1, 2, 3 and 4 show the portion of the front spar (2) connected to the fuselage (20) of the aircraft and FIGS. 1, 3 and 4 show the antenna coupler attached to the fuselage (20).

The whole antenna would be covered by a dielectric dorsal fin being protected from impacts or weather damage and to avoid adding additional aerodynamic drag to the aircraft and, at the same time, not disturbing the antenna radiation. An access door in the dorsal fin allows mounting and dismounting the antenna couplers (11) and the maintenance operations.

The antenna metallic radiating element is normally about 0.1 m wide and 1.3 m long, the antenna metallic plate has typically a width double that of the radiating element and a length equal or slightly greater. The distance between the radiating element and the metallic plate shall be enough to have an open area of about 0.5 square meters.

The antenna object of the claimed invention is designed for long range communications in the high frequency band (2 MHz to 30 MHz).

The invention claimed is:

1. An antenna assembly for aircraft comprising:

an antenna radiating element;

an antenna coupler in electrical contact with the antenna radiating element;

a portion of a vertical tail of the aircraft, wherein the portion of the vertical tail includes a portion of a front spar;

a first metallic element in electrical contact with the antenna coupler, wherein the first metallic element comprises said portion of the front spar, a second metallic element in electrical contact with the antenna radiating element and with the first metallic element, whereby the antenna radiating element is parallel to the portion of the front spar, and wherein the first and the second metallic elements and the antenna coupler are configured as an electrical circuit which in use is a closed loop current path flowing through said circuit.

2. The antenna assembly, according to claim 1 wherein the portion of the vertical tail includes a leading edge rib in contact with the front spar such that the second metallic element comprises said leading edge rib.

3. The antenna assembly, according to claim 2 wherein the antenna radiating element and the leading edge rib are in direct contact.

4. The antenna assembly, according to claim 1 wherein the first metallic element also comprises a metallic plate, wherein the metallic plate includes an attachment to the portion of the front spar.

5. The antenna assembly, according to claim 4 wherein the second metallic element comprises a metallic support mast extending between the antenna radiating element and the metallic plate.

6. The antenna assembly, according to claim 4 wherein the metallic plate comprises a grounded metallic attachment at a front end of the metallic plate, and the grounded metallic attachment is configured to be joined to the fuselage of the aircraft.

7. The antenna assembly, according to claim 6, wherein the grounded metallic plate extends to and contacts with the antenna coupler such that an electrical connection is formed between the metallic plate and the coupler.

8. The antenna assembly, according to claim 4 which further comprises at least a dielectric support mast extending between the antenna radiating element and the metallic plate.

9. The antenna assembly, according to claim 1 further comprising a portion of a fuselage whereby the fuselage is metallic and the antenna coupler is attached to the fuselage and the antenna coupler is also in electrical contact with the fuselage and the first metallic element is in electrical contact with the fuselage.

10. The antenna assembly, according to claim 1, further comprising an element configured to transmit electric current flowing between the first metallic element and the antenna coupler.

11. An antenna assembly for aircraft comprising:

a vertical tail of the aircraft including a front spar, a leading edge skin covering the front spar, and a rib extending between the front spar and the leading edge skin;

an antenna radiating element extending a length of the vertical tail and positioned between the leading edge skin and the front spar;

a first metallic element included with or attached to the front spar;

a second metallic element, wherein the second metallic element is electrically connected to the antenna radiating element and to the first metallic element;

an antenna coupler is electrically connected to the antenna radiating element and the first metallic element, and wherein a closed looped electrical circuit is formed by the antenna radiating element, the first metallic element, the second metallic element and the antenna coupler.

12. The antenna assembly of claim 11 wherein the antenna radiating element is a metallic beam having a first end attached to the antenna coupler and an opposite end attached to the second metallic element.

13. The antenna assembly of claim 11 wherein the second metallic element is a metallic support mast extending between the antenna radiating element and the front spar.

14. The antenna assembly of claim 11 wherein the antenna radiating element is parallel to the first metallic element.

15. The antenna assembly of claim 11 wherein metal forming the front spar comprises the first metallic element, and metal forming the rib comprises the second metallic element.

16. The antenna assembly of claim 11 further comprising a dielectric support mast extending between the front spar and the antenna radiating element.

17. The antenna assembly of claim 11 further comprising a grounded metallic plate attached to the second metallic element and a fuselage of the aircraft, wherein the closed loop includes the grounded metallic plate.

18. The antenna assembly of claim 17 wherein the closed loop includes a metallic portion of the fuselage.

* * * * *